US006988614B2

(12) United States Patent
Hemingway et al.

(10) Patent No.: US 6,988,614 B2
(45) Date of Patent: Jan. 24, 2006

(54) FOLDED FAST FOOD TRAY

(76) Inventors: George F. Hemingway, 7317 Caverna Dr., Los Angeles, CA (US) 90068; George F. Hemingway, II, 7317 Caverna Dr., Los Angeles, CA (US) 90068

( * ) Notice: Subject to any disclaimer, the term of this patent is extended or adjusted under 35 U.S.C. 154(b) by 309 days.

(21) Appl. No.: 10/236,751

(22) Filed: Sep. 4, 2002

(65) Prior Publication Data

US 2004/0040882 A1 Mar. 4, 2004

Related U.S. Application Data

(63) Continuation of application No. PCT/US01/08049, filed on Mar. 13, 2001.
(60) Provisional application No. 60/189,204, filed on Mar. 14, 2000.

(51) Int. Cl.
*B65D 85/00* (2006.01)

(52) U.S. Cl. ..... 206/217; 206/562; 229/904
(58) Field of Classification Search ..... 206/217, 206/218, 158, 486, 508, 561, 562, 563, 541; 220/23.83; 229/904
See application file for complete search history.

(56) References Cited

U.S. PATENT DOCUMENTS

| | | | | | |
|---|---|---|---|---|---|
| 930,890 | A | * | 8/1909 | Schlappich et al. | 294/159 |
| 2,640,589 | A | * | 6/1953 | Foster et al. | 206/562 |
| 3,149,770 | A | * | 9/1964 | Spillson | 206/562 |
| 3,181,770 | A | * | 5/1965 | Coe | 206/562 |
| 3,253,766 | A | * | 5/1966 | Coe | 206/563 |
| 5,639,137 | A | * | 6/1997 | Bakx | 294/87.2 |

* cited by examiner

*Primary Examiner*—Jim Foster
(74) *Attorney, Agent, or Firm*—Bruce A. Jagger

(57) ABSTRACT

A disposable folding food tray having container ports for mounting to a beverage container. The disposable tray is mounted to the beverage container such that the consumer need only hold the bottom portion of the container in one hand in order to support the food tray. The food tray includes a food support area the size and shape of which can be adjusted to accommodate any desired food item. The food tray need only have sufficient strength to support the food item, not the beverage container, thereby significantly reducing the amount and strength of material needed for the tray. The tray is convenient in that one of the consumer's hand is always free, and the tray can be configured to fold into either a right handed or left handed version. The folding food tray can be conveniently and inexpensively made from a single piece of cardboard and supplied to the site of use in a generally flat configuration. Folding to the final configuration is conveniently accomplished at the site of use.

10 Claims, 9 Drawing Sheets

Fig. 9
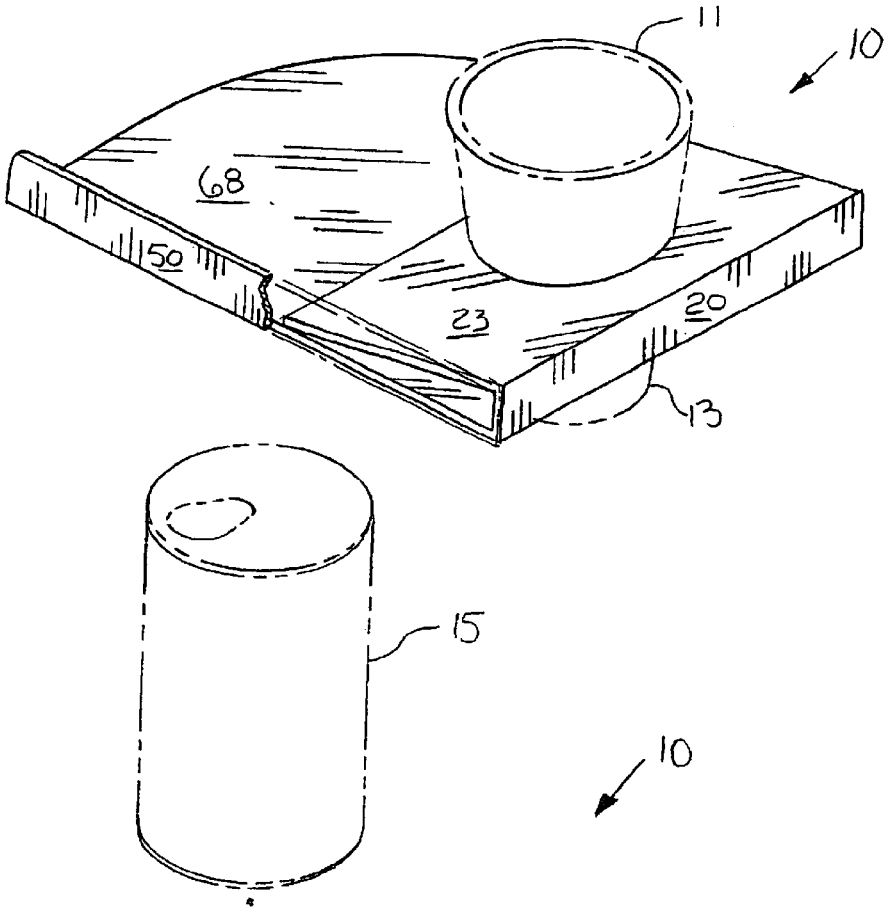
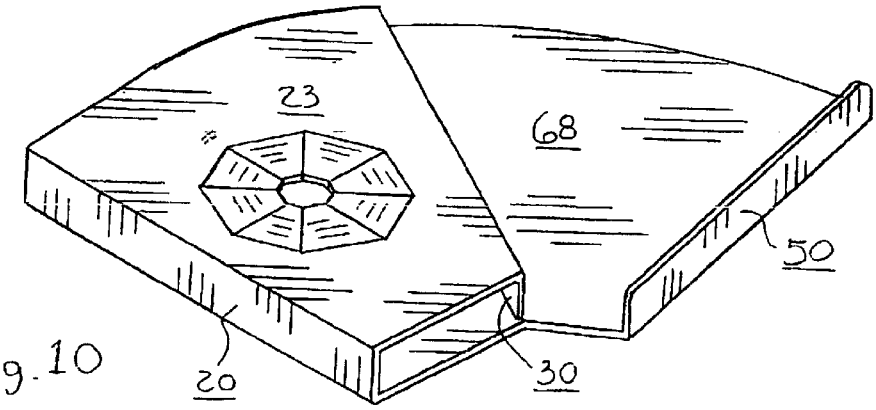
Fig. 10

FOLDED FAST FOOD TRAY

This application claims foreign priority under 35 U.S.C. 365(a) to PCT/US01/08049, filed on Mar. 13, 2001 which claims domestic priority under 35 U.S.C. 119(e) to U.S. Provisional Application 60/189,204, filed on Mar. 14, 2000.

BACKGROUND OF THE INVENTION

1. Field of the Invention

The invention relates in general to fast food trays, and, in particular, to a disposable food tray that is formed by folding a single sheet of stiff material, and is adapted to receive and be supported by a beverage container while supporting articles of food.

2. Description of the Prior Art

The fast food industry has substantially grown over the last few decades, and has also become very competitive. Those in the fast food industry are continuously looking for new ways to reduce costs while at the same time enticing consumers to purchase their product. One area of concern in the industry is the packaging of the food.

It has become commonplace for purchasers of fast food to consume the food while utilizing the packaging as a plate or bib. The fast food industry has recognized this phenomena and in response has developed the disposable food tray. However, since it is generally unacceptable to directly charge a customer for the disposable tray, great effort is made in the industry to provide these disposable food trays at the lowest possible cost. Hence, the fast food culture dictates these trays be provided for "free," making it clear that the cost of these trays bear directly on profit margins realized in the fast food industry. As such, the industry has a tremendous incentive to produce these trays at the lowest cost possible.

Low cost disposable fast food trays are typically configured in a rectangular shape or box. Due to their disposable nature and low cost, these trays are often flimsy and when heavily loaded are prone to accidents such as spilling, and the like. Beverages sold with fast food pose a significant problem in tray design as they are typically heavier in weight than food items, and are susceptible to tipping over when placed in a tray. Thus, most disposable fast food trays require the user to support the tray with both hands, particularly near the beverage containers. Although utilizing thicker, more rigid materials can solve this problem, doing so undesirably increases costs. Thus, most conventional disposable fast food trays are inherently flimsy and when loaded with food and/or beverages require the user to support the tray with both hands. Such flimsy disposable trays are not very desirable for the consumer. Having both hands occupied grasping these trays is not only burdensome, but also unsafe. For example, fast food consumers at sporting events, when grasping a flimsy tray with both hands, are unable to hold a handrail when ascending or descending stairs. This undesirably exposes the consumers to serious injury, and the promoters to liability. In addition, because both hands are occupied, these trays must be placed on the consumer's lap, chair or floor, in order to free up their hands to consume the food. This inconvenience results in numerous messes from inadvertent accidents. In some circumstances there is no place to put the food tray down, so potential customers forego buying items of food because they have no way to handle it. This undesirably works to the economic detriment of the concession owners.

Those concerned with these problems recognize the need for an improved disposable food tray that provides increased convenience and safety for the consumer while maintaining low production costs required by the industry.

These and other difficulties of the prior art have been overcome according to the present invention.

BRIEF SUMMARY OF THE INVENTION

A preferred embodiment of the folding fast food tray according to the present invention comprises a generally flat food support member having a first container port extending therethrough. The food support member joins a first spacer portion along a first fold line, which is in turn joined to an upper retaining portion along a second fold line. A second container port is provided in the upper retaining portion so that when the food tray is folded along the first and second fold lines, the first and second container ports are brought into approximal alignment for receipt of, and attachment to, a container. The ports are generally sized so that the container generally extends completely through the two ports in a direction that is generally perpendicular to the food support member and upper retainer portion. The container thus projects both above and below the plane of the food support member. This enables the user to support the food tray by grasping the lower portion of the container. In one embodiment, a second spacer portion is provided that is joined to the upper retaining portion at a third fold line. The second spacer portion has a generally straight exposed edge that is spaced apart from the third fold line and positioned in the folded configuration for engaging the support member. The fold lines are preferably arranged generally parallel to one another so that the food support member and the upper retainer portion extend generally parallel to one another. In another embodiment that does not utilize a second spacer portion, the food support member and upper retainer portion are not parallel and are generally angularly aligned. An assembly tab, if desired, can be provided protruding from the exposed edge of the second spacer portion for receipt into a tab receiving slot located in the support member to assure the tray holds its assembled configuration. The assembly tab, when present, serves to stabilize the location of the second spacer portion relative to the support member and to maintain the predetermined spacing between the support member and the upper retaining portion including the approximal alignment of the container ports. The support member has a food support area bounded, for example, on one side by a folding food retainer panel, or an edge of the support member, and the second spacer portion or the tab receiving slot, when present, on a generally opposed side. In one embodiment the food support area is wedge shaped and suited for supporting triangular shaped foods such as pizza or pie. The shape of the food support area can be modified to accommodate any shape of food item or aesthetic affect desired. The tray configuration can also be made symmetrical for either right hand or left hand use, if desired.

The food tray is preferably made from a single sheet of stiff material such as cardboard, and is preferably formed, shipped, and stored in a generally flat configuration. Folding to the final configuration is preferably accomplished at the site of use. The food tray is conveniently assembled by progressively folding it in approximately 90-degree bends in the same direction along at least two spaced apart fold lines. Once the assembly tab is retained in the tab receiving slot, if the tab and slot are provided, the container ports are brought into approximal alignment for receiving a beverage container therethrough. If the tab and slot are not provided, then the person that assembles the food tray has to position the container ports in approximate registry with one another so that a drink container can be inserted through both. A container or beverage is then inserted into the container ports thereby attaching the tray to the container. Preferably the container conforms generally to a frustoconical shape, but this is not essential to the successful use of the food tray. In a preferred embodiment, resilient hinged sectors are provided on the second container port to further assist mounting of the folded food tray to the beverage container. The configuration of the formed but unfolded sheet of material is such that it can be folded to accommodate either a left or right handed person. That is, the folds that are made to bring the ports into substantial registry can all be made in a direction either towards the right or towards the left, so long as they all are made in the same direction. In an alternative embodiment a symmetrical design provides for a single universal configuration of the food tray that is conveniently adaptable for identical use by either right handed or left handed users. The folds can be made, for example, in a first direction for right-handed people and in the opposite direction for left-handed people.

Once assembled and attached or mounted to a beverage container, the food tray can support food items on its upper surface while the user simply grasps the lower portion of the beverage container with one hand. The user grasps a lower portion of the beverage container that projects below the plane of the food tray. With the tray frictionally secured to the container, there is no need for the user to grasp the tray itself, as is required for conventional food trays. The beverage container is preferably grasped just below the food tray so that the hand of the user blocks the food tray from sliding down the wall of the beverage container. In one sense, the food tray is practically invisible to the user whose only required action is to hold the beverage container. The user is thus directly holding and has control over the heaviest part of the assembly. So long as the food tray is held approximately horizontal, and the material is stiff enough to resist bending under the weight of the food, the food items on its upper surface will stay there. The user can drink from a straw while holding the food tray and beverage container with one hand, all without fear of dropping the food. If desired, the food support area can be position by the user so that it extends over and is supported from the underside by resting on the user's arm. Thus, the support of both the tray and container only requires one arm. The other arm remains free for other tasks.

It is preferable that the food tray be configured so that the food support area is as close to the ports as possible. This reduces the length of the moment arm of the food. Although the food items are generally considerably lighter than the beverage, shortening this moment arm enhances the stability of the food tray and minimizes the amount of material needed to form the tray.

When in use, one hand of the user is always free to perform any number of tasks, such as consuming the food items, using a napkin, grasping a handrail, holding children, or the like. Accidents at public events can be avoided as users are free to grasp, for example, a hand rail, when ascending or descending stairs. Uniquely, the food tray can be used as food is being consumed without the necessity of placing the tray on the user's lap, chair, or the floor. This makes the tray well suited for use in standing events such as conventions, swap meets, markets, and the like. The tray can work to the economic advantage of concession operators, as potential consumers are enticed to purchase their food products upon seeing the convenience of the tray being used by others. For instance, fans utilizing the present invention at sporting events can consume the food or beverage with their free hand. Where some surface is available to support the tray, it can be placed on that surface where it will function as a normal food tray. In this situation the food tray serves its unique function when the user is carrying it from the food pickup point to the table or other support structure. In addition, since the bottom portion of the container protrudes through the tray, the tray is extremely well suited for use with chairs having beverage ports integrally molded into the armrests, as are found in many movie houses or theatres.

The final assembly is done at the point of use, so the food tray is conveniently shipped and stored flat. Shipping and storage are thus very economical. The tray is extremely economical to manufacture as it utilizes a minimal amount of flat stock material. The structural strength for the fully assembled (folded) food tray is primarily provided by the beverage container as it protrudes through the two spaced apart ports in the tray, and the stiffness of the food support member. The stiffness of the material prevents the food tray from bending under the weight of the food items. When the beverage container engages both spaced apart ports it imparts rigidity to the assembled configuration. A sheet of material is considered to possess the requisite stiffness if it does not bend significantly under the weight of the intended food item. The purpose in using a stiff material is to keep the food from sliding off of the food support area by reason of the support deflecting enough from the horizontal to allow the food items on it to slide off.

The nature of the sheet of material is that it is rigid or stiff rather than flexible. Corrugated cardboard is, for example, a suitable material for use as the stock material from which the food tray is formed. It is a lightweight, inexpensive composite that is stiff enough so that it will not bend or flex to any significant degree under the weight of the intended food items. The configuration according to the present invention is such that the tray only need structurally support the lightest load, that is, the food items, and not the beverage. This significantly minimizes the amount and strength of material necessary for the tray, thereby minimizing its cost. Production costs are also thereby reduced.

Two spaced apart ports in approximate registry with one another are used in the food tray to provide structural stability and strength. The ports are configured so as to accept variously shaped beverage containers therethrough, such as, for example, generally frustoconical containers, cylindrical containers, or rectangular containers. Preferably, the upper port is provided with some structure that serves to frictionally engage the beverage container so as to further stabilize the food tray and the relationship between the food tray and the beverage container. Preferably, the configuration of the food tray is such that the container is frictionally engaged with both the upper and lower ports.

Other objects, advantages, and novel features of the present invention will become apparent from the following detailed description of the invention when considered in conjunction with the accompanying drawings.

BRIEF DESCRIPTION OF THE DRAWINGS

The present invention provides its benefits across a broad spectrum of folded food trays. While the description which follows hereinafter is meant to be representative of a number of such applications, it is not exhaustive. As those skilled in the art will recognize, the folded food trays taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific examples disclosed.

Referring particularly to the drawings for the purposes of illustration only and not limitation:

FIG. 9 is a perspective view of the embodiment of FIG. 6 shown in a folded configuration for a left hand user and attached to a container.

FIG. 10 is a perspective view of the embodiment of FIG. 1 shown in a folded configuration for a right hand user attached to a cylindrical container.

DETAILED DESCRIPTION OF THE PREFERRED EMBODIMENTS

Figure 1:
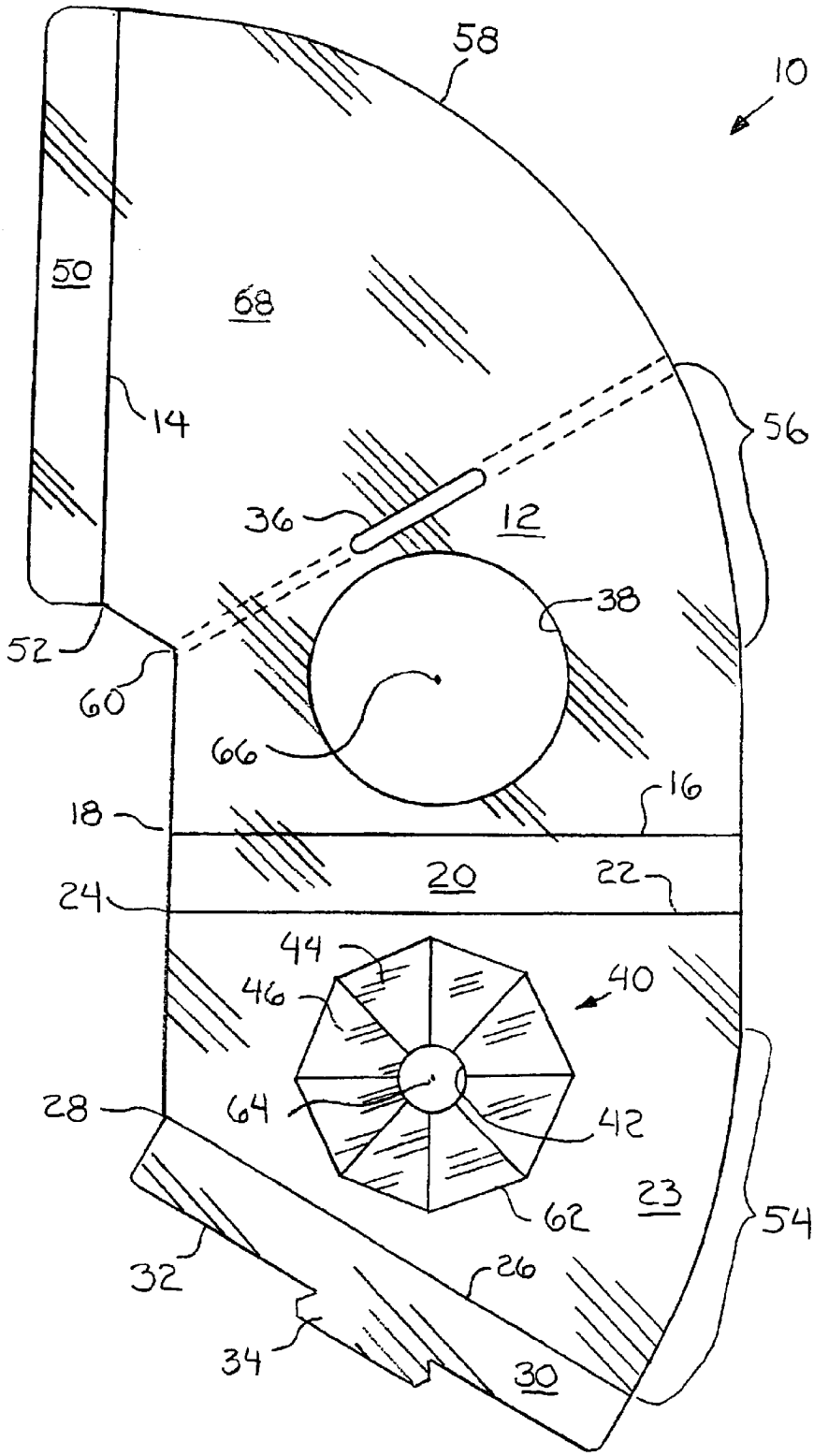
FIG. 1 is a top view of a preferred embodiment of the folding food tray shown in a flat, unfolded configuration, the bottom view being a mirror image of the top view.

Referring to the drawings for purposes of illustration only, there is indicated generally at 10 a folding food tray formed from a single flat sheet of material, for example, cardboard. Although alternative embodiments are shown herein, identical item numbers reflect common elements or features throughout the several views.

Referring particularly to FIG. 1, a generally flat base panel or member 12 is located in one region of the food tray for supporting food items generally at area 68. A first margin 14 and a second margin 16 bound the generally flat base panel or member 12 on its respective opposed edges. A port 38, which is, for example, generally annular, extends through the base panel 12 adjacent to the second margin 16 for receiving a container. A tab receiving slot 36 extends through the base panel 12 adjacent to the container port 38 and in line with exposed edge mount location 60. Exposed edge mount location 60 is generally in the form of a straight line or narrow straight region. Tab receiving slot 36 is spaced from the first margin 14 so as to define therebetween, for example, a generally wedge shaped food support area 68.

The longer edge of the generally wedge shaped food support area is, for example, generally arcuate, as indicated at 58. The center of port 38 is indicated at 66. The second margin 16 of base panel 12 is generally straight and defines a first fold line 18.

A first spacer panel 20 is joined to base panel 12 along second margin or fold line 16. The first spacer panel or spacer portion 20 has a first width that is defined as the distance between second margin 16 (first fold line 18) and third margin 22 (second fold line 24). Third margin 22 is on the opposed edge of first spacer panel or portion 20 from second margin 16, and is generally straight so,as to define the second fold line 24. According to the embodiment shown in FIG. 1, the second margin 16 and the third margin 22 extend generally parallel to one another.

An upper panel or retaining portion 23 is joined to the first spacer panel or portion 20 along the third margin 22. The upper panel or retaining portion 23 is bounded on its opposed edge by fourth margin 26. The fourth margin 26 is generally straight and defines a third fold line 28 in the embodiments shown in FIGS. 1 and 4.

An object clamping area or container port indicated generally at 40 is formed in the upper panel or portion 23 intermediate of the third and a fourth margins. In the embodiments shown in FIGS. 1, 4, and 10, the object clamping area or container port 40 is defined, for example, by an outer generally circular boundary 62, and a plurality of sectors, typical ones of which are indicated at 44 and 46. Although outer boundary 62 can generally be described as a circle, the folding edges of the sectors establish generally straight lines about the circumference of the circle, similar to the sides of, for example, an octagon. The more sectors, the more closely these folding edges approximate a circle. Other port shapes and gripping elements can be used if desired. The center of the clamping area 40 is indicated at 64. The sectors 44 and 46, for example, are formed by cutting the upper panel 23 to form gripping elements arranged in a gripping pattern, for example, along radial lines extending outwardly from center 64. In the embodiments shown in FIGS. 1, 4, and 10, the straight outer edges of sectors 44 and 46 remain resiliently hingedly attached along the circumference of boundary 62 to the sheet of material from which food tray 10 is formed. The sectors are thus foldable and therefore adapted to resiliently grip a container inserted into clamping area 40. The inner ends of the sectors are conveniently truncated along, for example, the circumference of circle 42 so that the sectors are unsupported except at their resiliently hinged outer edges. Thus, the insertion of an annular object, such as a beverage container, into clamping area or container port 40 forces the respective sectors to resiliently pivot about their respective hinged outer edges. This deflection is resisted by the sectors so that they act to grasp the annular object. Preferably, the sectors are long enough so that when fully deflected by the presence of a beverage container in port 40 they project through the lower port 38, thereby decreasing the effective diameter of the lower port. This is particularly effective in grasping generally cylindrical and other straight sided beverage containers. The sectors also accommodate tapered beverage containers with other than conical configurations. The gripping elements are preferably formed from the same material as the rest of the food tray. Typically, the gripping elements are formed by cutting a pattern into the material and are part of the food tray. Alternatively, they could form part of the beverage container. Also, the edges of the ports can serve to grasp the beverage container. For example, to accommodate a frustoconical shaped container the upper port can have a slightly larger diameter than the lower port. The ports are sized and shaped to accommodate the sizes and shapes of the beverage containers with which it is anticipated that the food tray will be used with. Several different sizes and shapes of beverage containers can be accommodated by the same ports because the grasping elements generally automatically adjust to the various sizes and shapes. The food trays according to the present invention are generally intended to be used only once, although they can be reused, if desired. That is, they are intended to be disposable.

Figure 4:
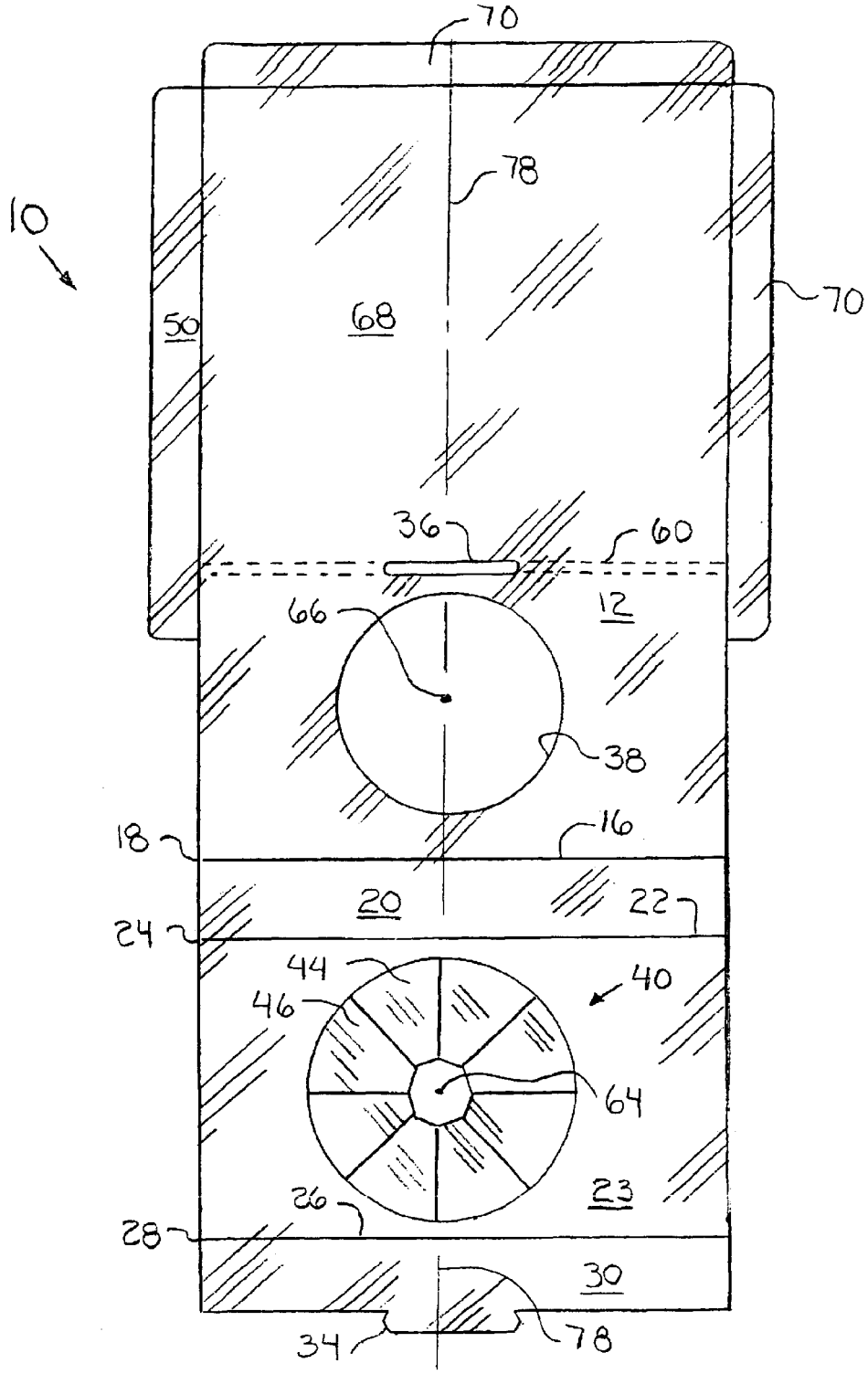
FIG. 4 is a top view of another embodiment of the folding food tray shown in a fiat, unfolded configuration, the bottom view being a mirror image of the top view.
Figure 11:
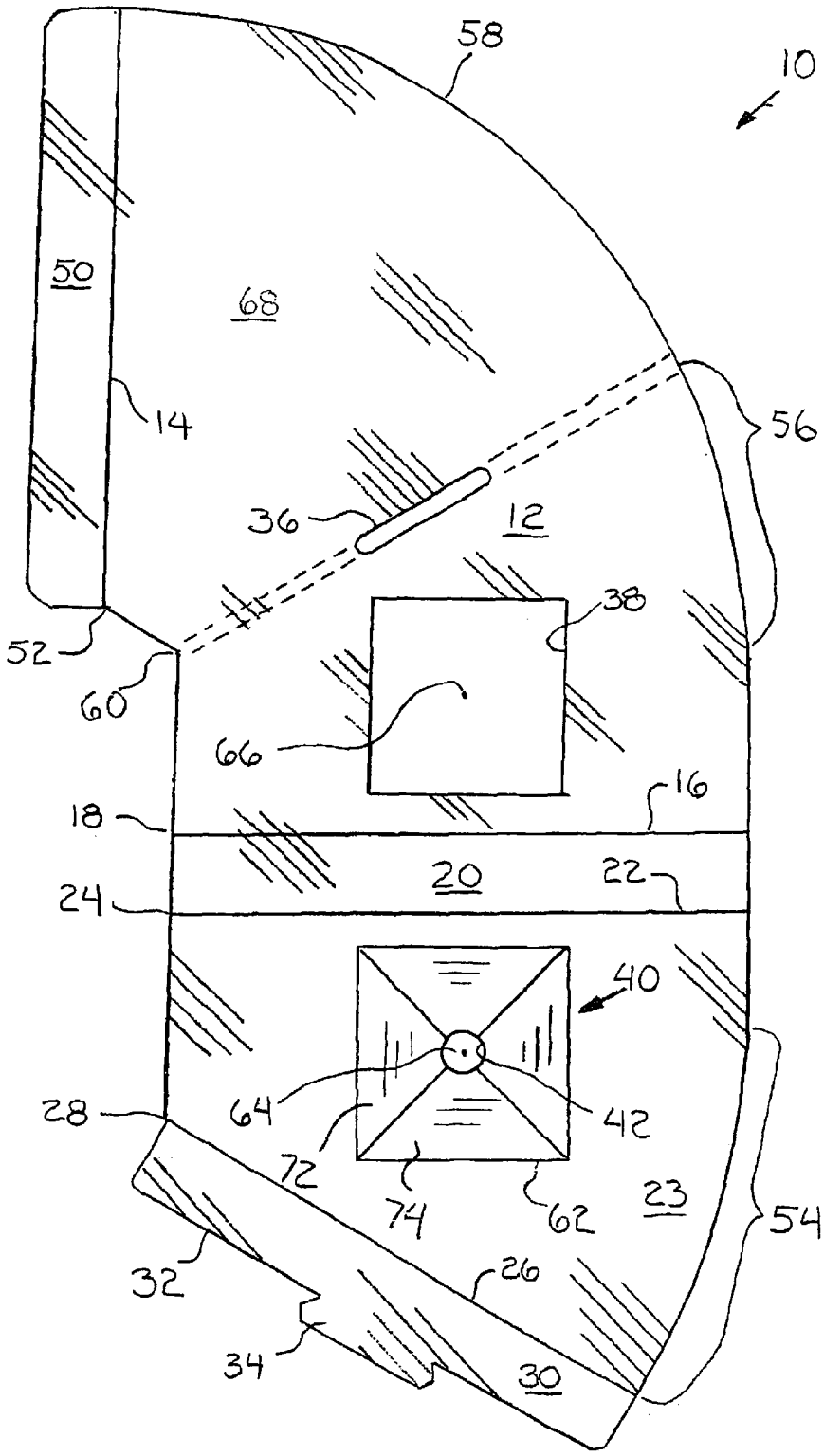
FIG. 11 is a top view of still yet another embodiment of the folding food tray shown in a flat, unfolded configuration, the bottom view being a mirror image of the top view.

In the embodiments shown in FIGS. 1, 4, and 11, a second spacer panel or portion 30 is joined to upper panel or retaining portion 23 along the fourth margin 26. The margin 26 is generally straight and defines a third fold line 28. The opposed edge of second spacer panel 30 is defined by an exposed edge 32. Exposed edge 32 is preferably straight. The second spacer panel 30 has a second width that is defined by the distance between the fourth margin 26 and the exposed edge 32 of second spacer panel 30. The exposed edge 32 engages the food support member 12 when the food tray is folded into position and upon receipt of and attachment to an annular object such as a container. In the embodiments shown in FIGS. 1, 4, and 11, to assist the engagement of exposed edge 32 with the food support member 12, an assembly tab 34 is provided extending outwardly from and in generally the same plane as second spacer panel 30. Assembly tab 34 projects beyond exposed edge 32. A tab receiving slot 36 is provided in the food support member 12 to accept the assembly tab when the food tray is folded into position. Although just one assembly tab/receiving slot is shown, additional tabs and slots can be provided, if desired.

Referring to FIG. 1, a food retainer panel 50 is joined to base panel or food support member 12 along margin 14 for preventing food from sliding off the food support member. Additional retainer panels can be provided, if desired, as shown at 70 in FIGS. 4 and 5. In the embodiment shown in FIGS. 4, 5, 7, and 8, the food retainer panel 50 extends past exposed edge mount position 60 so that when folded, the retainer panel enhances the rigidity of the food support area to hold food. Referring back to FIG. 1, first margin 14 is generally straight and defines fold line 52. In this embodiment a food support area is defined between the retainer panel 50 and the tab receiving slot 36 along exposed edge mount position 60. Although a generally wedge shaped or triangular food retainer panel is shown in this embodiment, differently shaped panels can be provided, if desired. The shape of the food panels is, for example, generally determined by the spatial configuration of the food to be supported on the tray, and/or by aesthetic considerations, or the like.

Figure 2:
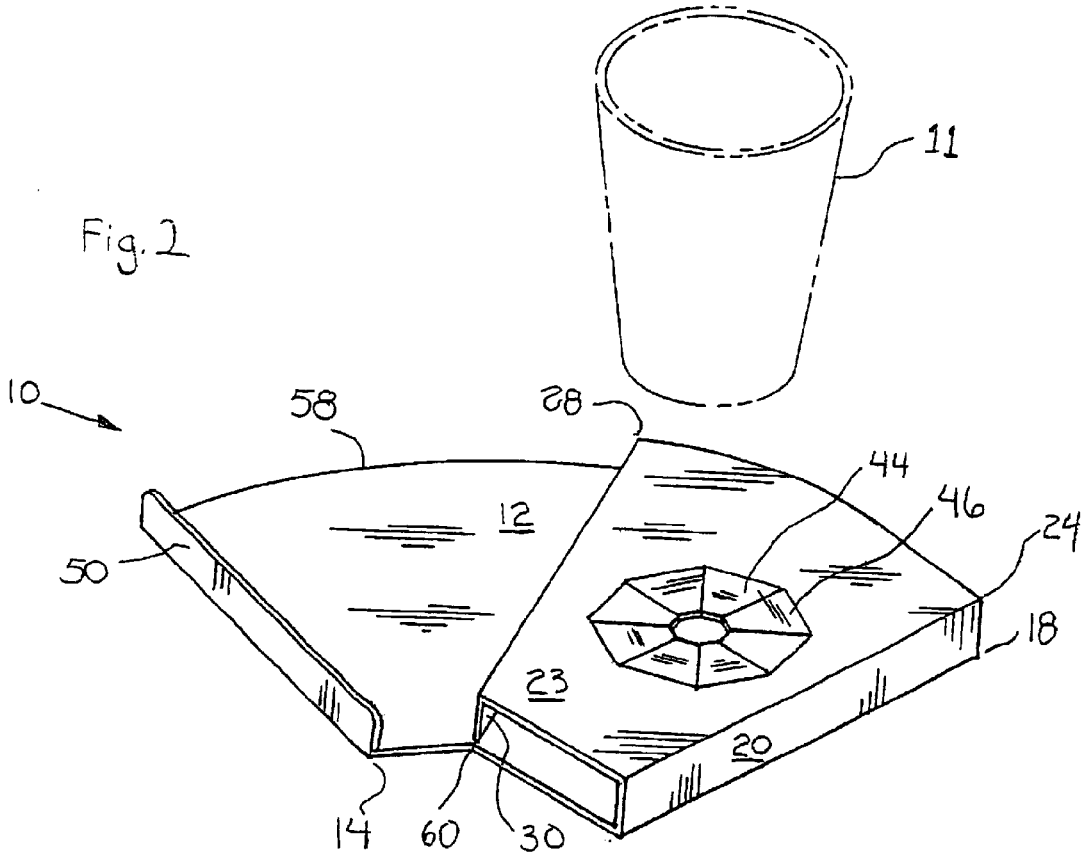
FIG. 2 is a perspective view of the preferred embodiment of FIG. 1 shown in a folded configuration for a left hand user.
Figure 3:
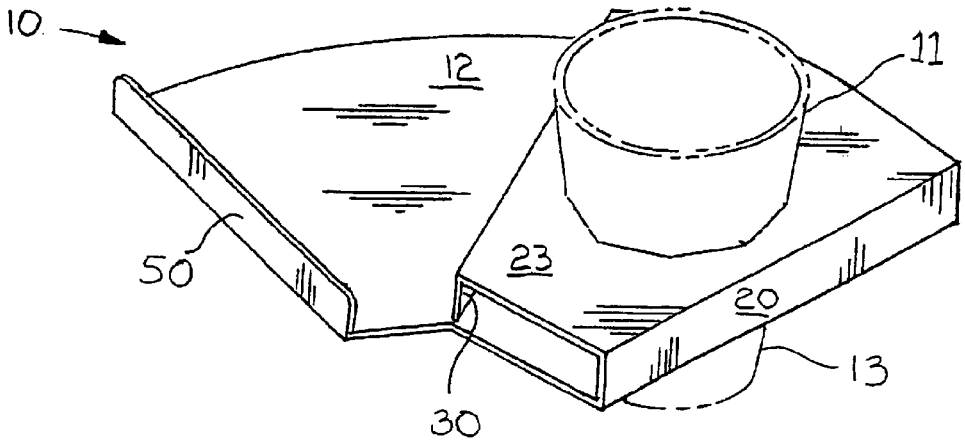
FIG. 3 is a perspective view of the preferred embodiment of FIG. 2 shown attached to a container.

Referring to FIGS. 1 through 3, starting with food tray 10 in the generally flat configuration, it is conveniently assembled into a food tray that will hold, for example, a slice of pizza or pie when attached to a drink container. The tray is assembled by progressively folding it in approximately 90 degree bends in the same direction along the respective fold lines. Folding along first fold line 18 to the extent of approximately 90 degrees brings first spacer panel 20 into a position where it extends generally perpendicular to the plane of base panel 12. A similar 90 degree fold in the same direction along second fold line 24 brings upper panel 23 over base panel 12 with centers 64 and 66 generally in registry with but spaced from one another by approximately the width of first spacer panel 20. Bending second spacer panel 30 down in the same direction through approximately a 90 degree arc along third fold line 28 brings exposed edge 32 into position where it rests on the surface of base panel 12 along line 60. Assembly tab 34 is also in position to be inserted into tab receiving slot 36. FIG. 2 shows the food tray 10 folded into a configuration with assembly tab 34 inserted into receiving slot 36 wherein the first and second container ports are in approximal spaced apart alignment and ready for receipt of and mounting to container 11.

FIG. 3 shows the food tray 10 after receipt of and mounting to container 11. Due to the unique gripping nature of the port in the food tray, food can be securely supported on the tray while the user simply grasps the bottom portion 13 of the container. Thus, the food tray does not require any handling by the user to support the food other than simply holding, for example, a beverage container in one hand. Uniquely, the user has one free hand to manipulate and consume whatever foodstuff is provided on the tray. The convenience that is offered by this unique feature makes the food tray very desirable in the fast food industries, sport concession stands, and the like.

Not only is the folding food tray adapted to allow the user the free use of one hand, in some embodiments the design is uniquely universal in that it can be folded into either a left hand user configuration or a right hand user configuration. For example, the embodiment shown in FIG. 1, folded as discussed above and shown in FIGS. 2 and 3, has been folded in a left hand configuration wherein the user's right hand is intended to grasp the container and the user's left hand is free to manipulate, for example, a slice of pizza. In the embodiment shown in FIG. 1, when folded in an opposite direction to that discussed above will produce a right hand configuration that is a mirror image of the left hand configuration. The right hand configuration of the embodiment of FIG. 1 is shown in FIG. 10 wherein the user's left hand is intended to grasp the container and the user's right hand is free. Although a left hand and right hand configuration has only been shown in the figures for the embodiment of FIG. 1, all of the embodiments shown and disclosed herein inherently possess the extremely versatile right/left hand feature, or are symmetrically configured to produce a universal configuration that can be conveniently utilized equally by both right and left hand users.

Figure 5:
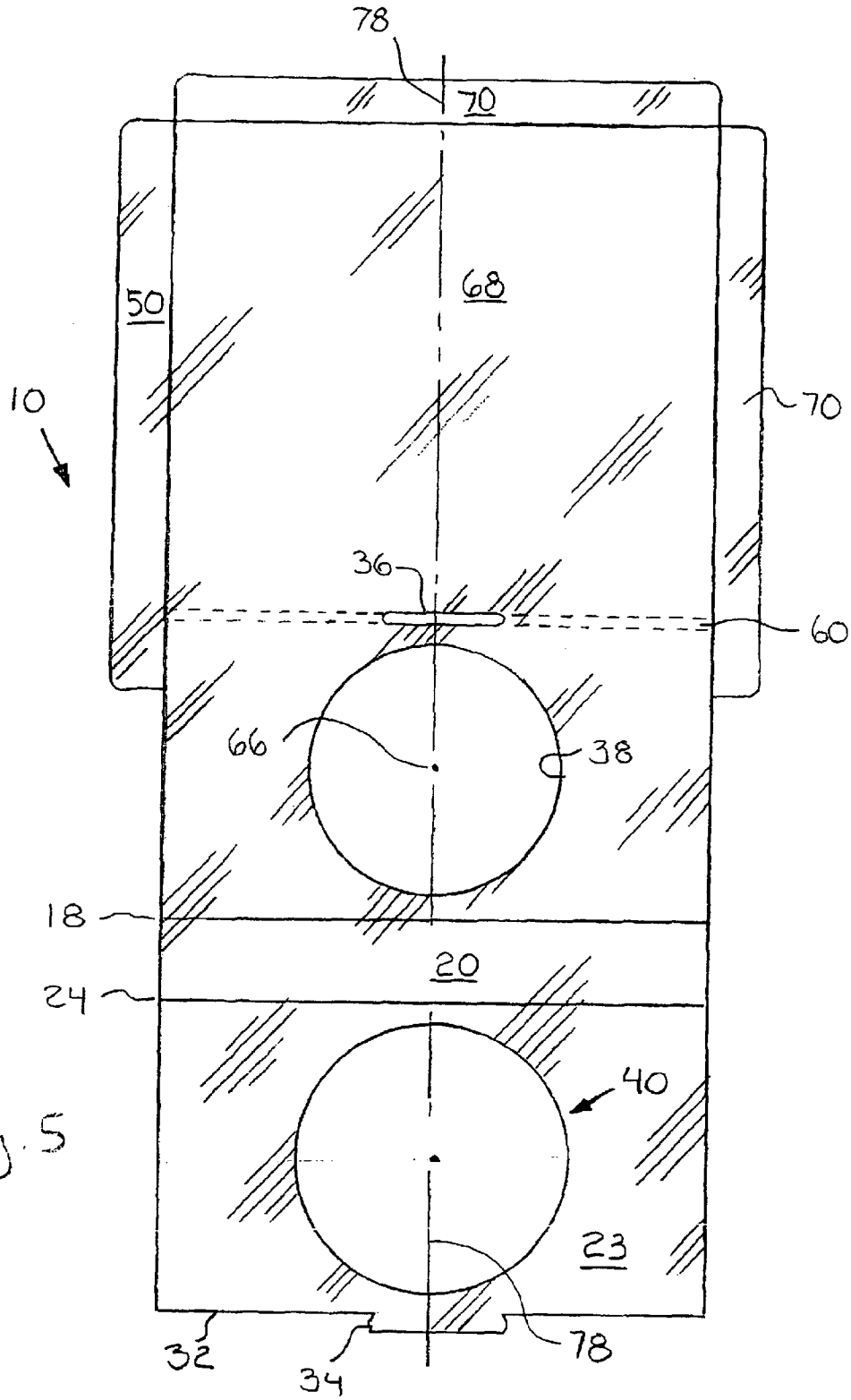
FIG. 5 is a top view of yet another embodiment of the folding food tray shown in a flat, unfolded configuration, the bottom view being a mirror image of the top view.

It is to be appreciated that the embodiments shown in FIGS. 4 and 5 are symmetrical about their fold lines, and although either embodiment can be folded in two opposite manners, the resulting configurations are substantially identical. Thus, for the embodiments shown in FIGS. 4 and 5, only one folded configuration is possible, and this configuration is generally symmetrical and thereby equally adapted for the convenient use by both right and left handed users. This symmetry can only be achieved when all three fold lines 18, 24 and 28 are parallel, and when all portions of the tray are mirror images about a central line, shown at 78, running perpendicular to these fold lines. Thus, this symmetrical and universal feature is generally not adaptable for use in, for example, the wedge shaped embodiments.

Referring to the embodiment shown in FIG. 1, the distance between base panel 12 and upper panel 23 is generally determined by the respective widths of first and second spacer panels 20 and 30, respectively. If the fold lines 18 and 24 are parallel, fold line 28 is parallel to exposed edge 32, and the width of first spacer panel 20 is approximately the same as the width of the second spacer panel 30, the upper panel 23 will extend approximately parallel to base panel 12. The arcuate portion 54 of upper panel 23 is generally in registry with the arcuate portion 56 of base panel 12. As will be clear to those skilled in the art, if the fold lines are not parallel or the widths of the spacer panels are different, the upper panel will not extend parallel to the base panel, and such a non-parallel spacial relationship may be employed, if desired.

Positioning fold line 28 at an angle to fold line 24 gives the top surface of upper panel 23 a wedge or triangular shape as shown, for example, in FIGS. 2, 3, 10, 12. This also permits the food support area between line 60 and fold line 52 to assume a wedge or triangular shape, which is desirable for such foods as a slice of pizza or pie. Alternatively, fold line 28 can be positioned in a parallel relationship with fold line 24 to give the top surface of upper panel 23 a rectangular shape, as shown, for example, in FIGS. 7, 8, and 9. In the embodiment of FIG. 1, when food retainer panel 50 is folded up through approximately a 90 degree angle in a direction opposite to the other folds, it extends generally perpendicular to the surface of the food support area 68. The sides of the food support area 38 are thus bounded on opposed sides by walls that are defined by the faces of food retainer panel 50 and second spacer panel 30 so as to prevent food from sliding off the food support member. Triangular food items, such as, for example, pie or pizza, are thus efficiently retained on the food support area of base panel 12. Other shapes of the food support area are possible, generally depending on the shape of the food desired or by some aesthetic consideration, of which a few such configurations are shown in the other embodiments.

In the embodiment of FIG. 1, the arcuate radially outer edge 58 of base panel 12 generally follows the curve that is evidenced by a sector shaped food item. The food tray 10 is thus very compact, providing only the structure that is necessary to support a generally wedge or other shaped food item with a drink container. The compactness of the assembled food tray is enhanced by the use of an arcuate radially outer edge. Such a configuration also removes the opportunity for a food item to be placed so far from the port area that there is a risk of its weight bending the panel 12.

An object, such as, for example, a frustoconical drink container, shown throughout the views at 1t, when inserted into the object clamping area 40 of upper panel 23 will extend through port 38. Commonly, drink containers are frustoconical in shape so that the larger part of the container is positioned in the object clamping area 40 and the smaller end is received in port 38. This shape is typically the standard for disposable beverage containers that are provided at the sites where food is prepared. Various sizes and shapes of drink containers are accommodated by the variable sized and shaped gripping area that is provided by object clamping area 40. For example, as shown in FIG. 10, a cylindrical container 15 may be inserted and the food tray mounted thereto, if desired.

Figure 6:
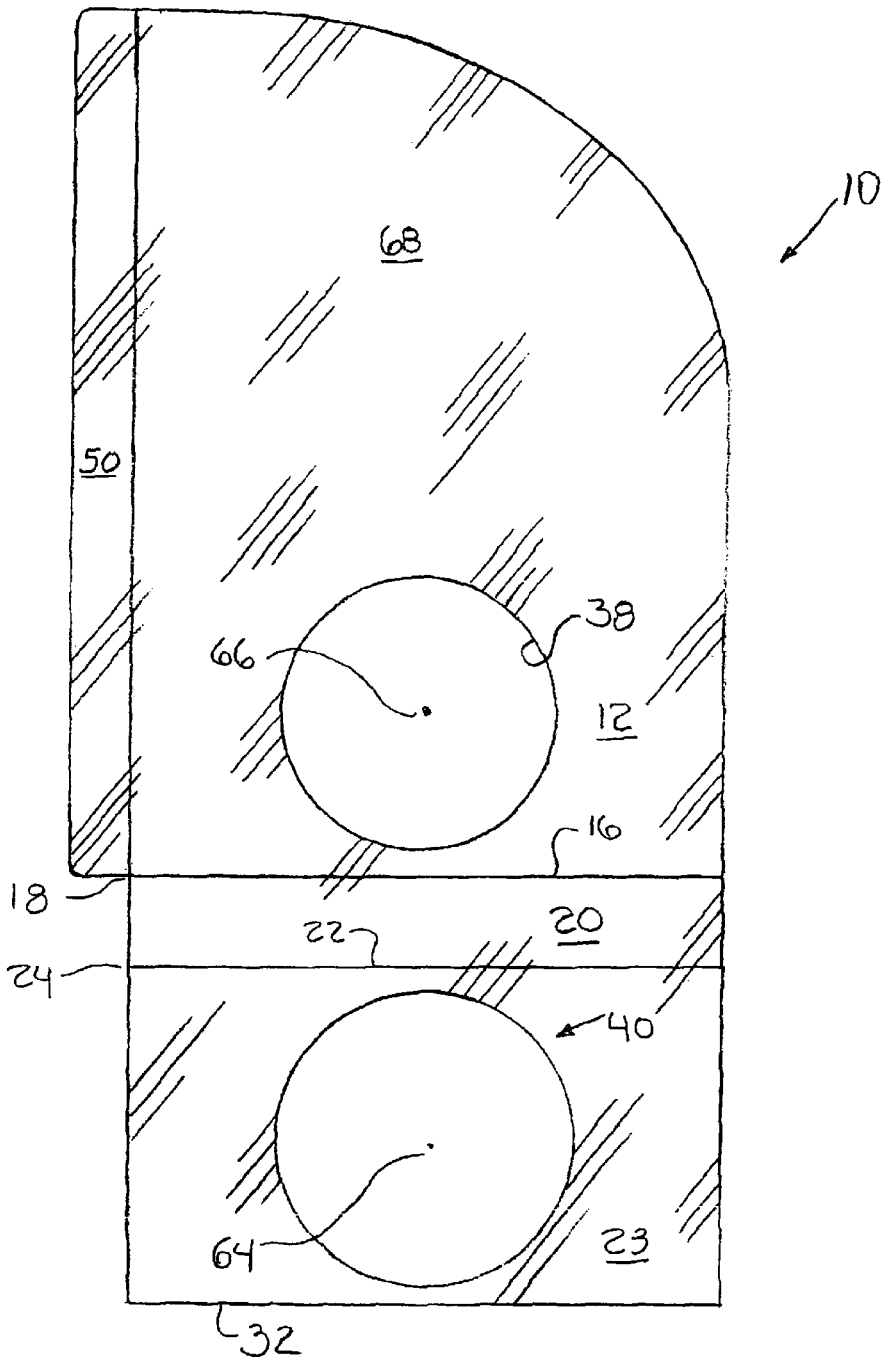
FIG. 6 is a top view of still yet another embodiment of the folding food tray shown in a flat, unfolded configuration, the bottom view being a mirror image of the top view.
Figure 7:
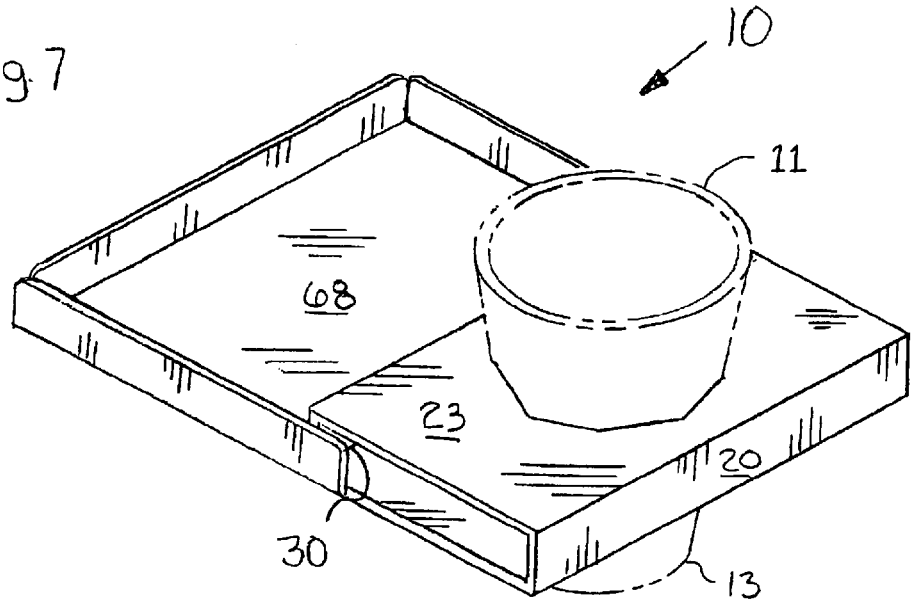
FIG. 7 is a perspective view of the embodiment of FIG. 4 shown in a folded configuration and attached to a container.
Figure 8:
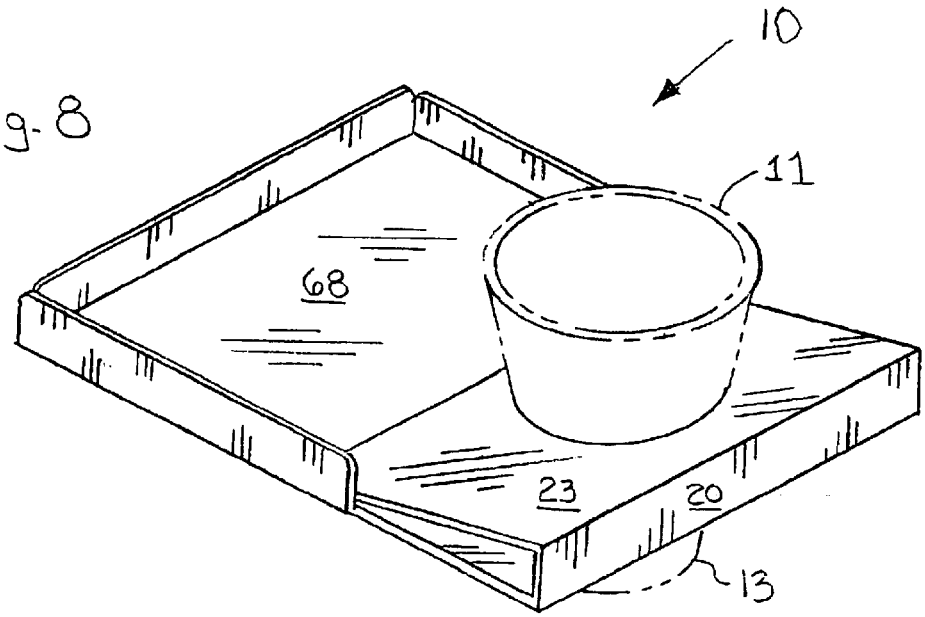
FIG. 8 is a perspective view of the embodiment of FIG. 5 shown in a folded configuration and attached to a container.

It is to be appreciated that nearly an infinite number of configurations of the present invention folding food tray can easily be made. For instance, the second spacer portion 30, assembly tab 34, and tab receiving slot 36 could be eliminated, if desired, as shown in the embodiment of FIG. 6. Such a tray would be somewhat more difficult to assemble and mount to the drink container, and would likely be less structurally stable, but would save on material. The food support area could be configured in numerous shapes depending on the type of food to be served, keeping in mind that the weight of the food items should be as close to the drink container as possible.

The sectors 44, 46 could also be eliminated, if desired, so long as both container ports are appropriately sized so as to attach or grasp a particular container when inserted therein. For example, in the embodiments shown in FIGS. 5 and 6, the sectors have been removed and the first and second ports are provided in a true circular configuration where gripping of the beverage container is accomplished by frictional engagement between the container and the edges of the ports. The ports can be of different diameters if desired, for example, to accommodate the taper of a frustoconical container. However, the use of sectors as the gripping elements are generally preferred as they more securely attach or grasp a wider range of variously sized and shaped containers.

Figure 12:
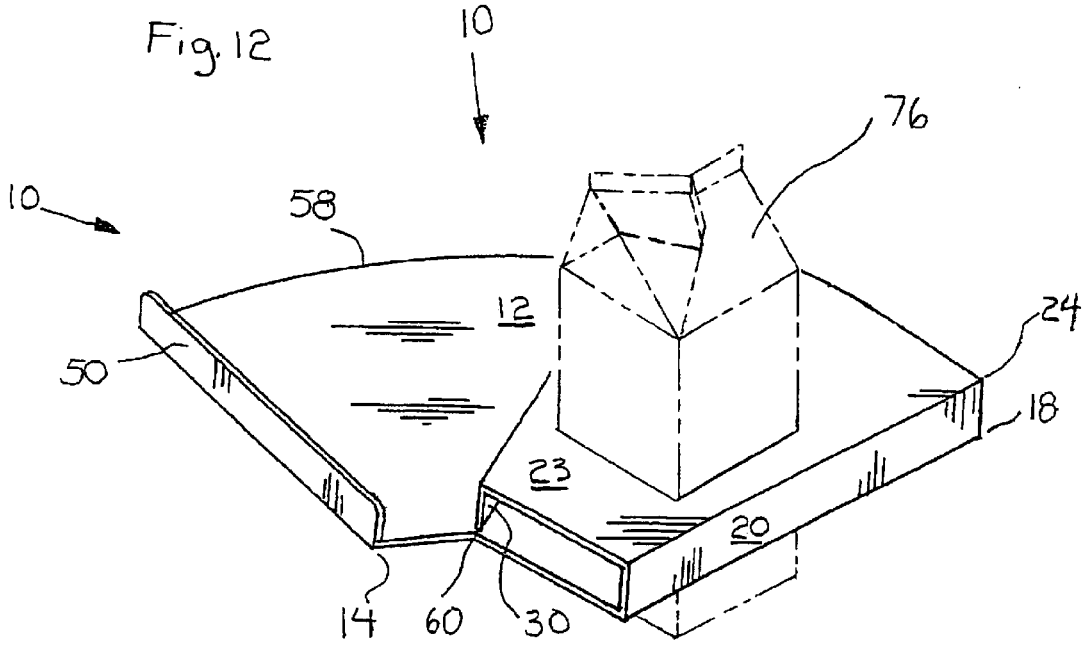
FIG. 12 is a perspective view of the embodiment of FIG. 11 shown in a folded configuration for a left hand user and attached to a rectangular container.

It is to be appreciated that the configuration of the first container port 38 and second container port 40 can assume any number of shapes other than circular or octagonal. For example, in the embodiment shown in FIG. 11, the ports, 38 and 40, are shaped in a square configuration. Upper port 40 is provided with triangular shaped gripping elements 72 and 74 that are resiliently hingedly attached to upper retaining portion 38 in a similar fashion as the sector gripping elements of the embodiments in FIGS. 1 and 4. As shown in FIG. 12, this square configuration is convenient for use in attaching the tray to square shaped containers 76, such as milk or juice containers, if desired. The ports can also assume a multitude of shapes such as triangular, trapezoidal, elliptical, rhomboidal, or the like. Whatever the shape, it is to be appreciated any number of port configurations can be used to attach to any number of container configurations. For example, a frustoconical container could be attached to the square port configuration shown in FIG. 11, and a cylindrical container could be attached to the circular port configuration shown in FIG. 1.

The food tray 10 is conveniently formed by one operation. A die, for example, a steel rule die is employed to form all of the cutting and scoring operations on a single flat sheet of material, for example, a cardboard sheet. A generally flat sheet of material is positioned in the die and one cycle of the die forms the food tray. The configuring cuts are made and the fold lines are scored. If there is a grain to the material, such as the corrugations found in cardboard, the grains are oriented so as to best support the food items. Generally, when corrugated cardboard is used, it is preferred to orient the corrugation grains outward from the container ports and towards the food support area.

The food tray 10 is shipped and handled in the unfolded condition. It is quickly and easily assembled into the folded configuration at the site of use. Because of the efficient utilization of material by this compact design, less material is required than would be the case with, for example, a rectangular food tray of approximately the same capacity. The design is attractive and convenient to consumers of fast foods.

It is to be appreciated that conventional folding food trays become extremely flimsy when beverages are placed on them, as beverages sold in the fast food industry are generally substantially heavier than fast food. The conventional wisdom in the art was to create a thicker, sturdier tray to support these heavy beverages. However, the present invention takes an unexpectedly different approach. Instead of making the food tray more sturdy to support beverages placed thereon, the present invention utilizes the beverage as structural support for the food tray. According to the present invention, the consumer grasps and supports the beverage container, rather than the food tray. Because the food tray of the present invention need only provide structural support for the food items and not the beverage, a significant savings in material for the tray is achieved while at the same time providing a more useful product. Because the beverage container protrudes through the tray, the user directly supports the container, which in turn supports the food tray, which in turn supports the food items. Once the tray is secured to the container, there is no need for the user to handle the food tray, as is typically required for conventional food trays.

What have been described are preferred embodiments in which modifications and changes may be made without departing from the spirit and scope of the accompanying claims. Obviously many modifications and variations of the present invention are possible in light of the above teachings. It is therefore to be understood that, within the scope of the appended claims, the invention may be practiced otherwise than as specifically described.

What is claimed is:

1. A food tray formed by folding a single sheet of stiff material comprising:

a generally flat base panel having a first margin, a second margin, a first port extending through said base panel adjacent said second margin, and a tab receiving slot extending through said base panel adjacent said port and spaced from said first margin to define a food support area between said tab receiving slot and said first margin, said second margin being generally straight and defining a first fold line;

a first spacer panel joined to said base panel along said second margin and having a first width, a third margin spaced from said second margin by approximately said first width, said third margin being generally straight and defining a second fold line;

an upper panel joined to said first spacer panel along said third margin and having a fourth margin spaced from said third margin, said fourth margin being generally straight and defining a third fold line, said third fold line not being parallel to said second fold line, a second port formed in said upper panel intermediate said third and fourth margins;

a second spacer panel joined to said upper panel along said fourth margin and having a second width, said second spacer panel having an exposed edge spaced from said fourth margin by approximately said second width, an assembly tab projecting from said exposed edge, said tab receiving slot being adapted to receive said assembly tab therethrough, said second port being adapted to being positioned in substantially registry with and spaced from said first port by approximately said first and second widths, said first and second ports being adapted to receive a container projected therethrough.

2. A food tray according to claim 1 wherein said single sheet of material comprises cardboard.

3. A food tray according to claim 1 wherein there is only one assembly tab.

4. A folding food tray according to claim 1 adapted to be folded into two configurations, one configuration for a right hand user and the other configuration for a left hand user.

5. A folding food tray according to claim 1 wherein said tray is symmetrical about said fold lines such that when folded together in either of two opposite manners only one symmetrical configuration will result.

6. A food tray of claim 1 wherein at least one of said first and second container ports including container gripping elements adapted to grip said container and hold said food tray on said container with a portion of said container normally below said generally flat base panel being graspable by a human hand.

7. A food tray of claim 1 wherein said first and second ports being adapted to hold said container therewithin to support said food tray.

8. A food tray formed by folding a single sheet of stiff material comprising:

a generally flat base panel having a first margin, a second margin, a first port extending through said base panel adjacent said second margin, and a tab receiving slot extending through said base panel adjacent said port and spaced from said first margin to define a generally wedge shaped food support area between said tab receiving slot and said first margin, said second margin being generally straight and defining a first fold line;

a first spacer panel joined to said base panel along said second margin and having a first width, a third margin spaced from said second margin by approximately said first width, said third margin being generally straight and defining a second fold line;

an upper panel joined to said first spacer panel along said third margin and having a fourth margin spaced from said third margin, said fourth margin being generally straight and defining a third fold line, a second port formed in said upper panel intermediate said third and fourth margins;

a second spacer panel joined to said upper panel along said fourth margin and having a second width, said second spacer panel having an exposed edge spaced from said fourth margin by approximately said second width, an assembly tab projecting from said exposed edge, said tab receiving slot being adapted to receive said assembly tab therethrough, said second port being adapted to being positioned in substantially registry with and spaced from said first port by approximately said first and second widths, said first and second ports being adapted to receive a container projected therethrough.

9. A food tray according to claim 8 wherein said single sheet of stiff material comprises cardboard.

10. A food tray according to claim 8 wherein said generally wedge shaped food support area includes opposed edges of different lengths and the longer of said opposed edges being generally arcuate.

* * * * *